US008203062B2

(12) United States Patent
Case et al.

(10) Patent No.: US 8,203,062 B2
(45) Date of Patent: Jun. 19, 2012

(54) DRUM WITH ADJUSTABLE DEPTH

(76) Inventors: Wayne Lee Case, Gilbert, AZ (US); Todd Joseph Norris, Chandler, AZ (US)

( * ) Notice: Subject to any disclaimer, the term of this patent is extended or adjusted under 35 U.S.C. 154(b) by 122 days.

(21) Appl. No.: 12/550,182

(22) Filed: Aug. 28, 2009

(65) Prior Publication Data

US 2010/0218662 A1 Sep. 2, 2010

Related U.S. Application Data

(60) Provisional application No. 61/190,571, filed on Aug. 28, 2008.

(51) Int. Cl.
*G10D 13/02* (2006.01)

(52) U.S. Cl. ..... 84/411 R

(58) Field of Classification Search ..... 84/421, 84/411 R

See application file for complete search history.

(56) References Cited

U.S. PATENT DOCUMENTS 2,546,452 A * 3/1951 Kmieliauskas ..... 84/412
6,963,022 B2 * 11/2005 Okuno ..... 84/413
7,781,659 B2 * 8/2010 Liao ..... 84/412

* cited by examiner

*Primary Examiner* — Kimberly Lockett
(74) *Attorney, Agent, or Firm* — Booth Udall, PLC

(57) ABSTRACT

A drum with an adjustable depth is described. The drum includes a top head, a bottom head, and a shell. The shell is constructed such that the bottom head can be moved away from the top head, creating a drum with a different depth. The shell comprises an inner and outer shell. A handle can be turned, turning a drive sleeve in the interior of the drum. The drive sleeve translates the rotational motion into a vertical motion, changing the distance between the top and bottom heads. There may be an additional drive sleeve directly across from the initial drive sleeve, coupled via a drive shaft, to force the drum heads to move apart from each other in a substantially parallel manner. In a similar manner additional drive sleeves may be present to better keep the heads parallel.

20 Claims, 4 Drawing Sheets

DRUM WITH ADJUSTABLE DEPTH

CROSS REFERENCE TO RELATED APPLICATIONS

This application claims priority to U.S. Provisional Patent Application 61/190,571, filed Aug. 28, 2008, the disclosure of which is hereby incorporated by reference in its entirety.

BACKGROUND

1. Technical Field

This disclosure generally relates to a musical instruments, and more particularly to drums.

2. Background Art

A drum kit, such as that used by jazz and rock drummers, typically contains drums of different sizes. Each drum has a different pitch and sound quality caused by, inter alia, the size of the drum. Typically, a drum kit will have a snare drum, one or more tom-toms, and one or more bass drums. A tom-tom is cylindrical with no snare. A snare drum is a cylindrical drum with a mechanism that presses some type of wire, such as metal, or cat gut, against the bottom head. These wires rattle to some degree as determined by the drummer to provide a distinctive rattle sound that sets the drum apart from drums without such wire mechanism. The multiple tom-toms will each having a different diameter and/or depth. Different size drums make higher or lower pitched sounds depending on diameter and depth combinations. The larger the drum diameter and depth, the lower pitched sound from the drum (assuming equal head tension). For a right-handed drummer, the tom-toms are typically mounted such that the drums with lower pitch are to the right of drums with a higher pitch. Thus, as the tom-toms go from left to right, they typically either deeper or larger diameter, or both.

A typical drum kit will also include a snare drum. A typical snare drum size is approximately 3 to 6 inches deep by between 13 and 15 inches in diameter, typically denoted as (for example) 5×14 for a drum that is 5" deep by 14" in diameter. Although some drummers have multiple snare drums, most drummers have a drum kit which usually has only a single snare drum. For a drummer who plays a wide variety of music, this can be a limitation because he may need to have very different drum sounds for different songs in order to capture the proper musical effect for each. It is desirable to have a drum that solves these and other problems.

SUMMARY

Aspects of this disclosure relate to a drum in which the distance between the bottom head and the top head is adjustable. In one aspect, such a drum may include a shell, a top head coupled to the shell, and a bottom head coupled to the shell. The distance between the top head and the bottom head is adjustable between a minimum distance and a maximum distance.

In another aspect, throughout the range of movement, the top head and the bottom head remain substantially parallel to each other throughout the range of motion. There may be a frame to which the drum is coupled. The frame is fixed in relation to the top head, such that when the frame is placed on a drum stand, the position of the top head remains constant. The bottom head moves vertically within the frame. In another aspect, the drum may have an inner shell and at least one outer shell. The outer shell moves with respect to the inner shell such that, in certain positions, the outer shell overlaps with the inner shell.

The drum may be a snare drum, a tom-tom, a bass drum, or any other type of drum.

The drum contains a mechanism that enables a user to change the distance between the top head and the bottom head. The mechanism includes a pair of drive sleeves and a drive shaft that couples the drive sleeves. As the drive sleeve is moved, the heads are moved with respect to each other. A device is used to operate the drive sleeve. The device may include a handle, a foot pedal, or a variety of other configurations.

The foregoing and other aspects, features, and advantages will be apparent to those having ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

The following descriptions are of exemplary embodiments of particular implementations of a drum and are not intended to limit the scope, applicability or configuration of the claims in any way. Rather, the following descriptions are intended to provide convenient illustrations for implementing various embodiments of a drum. As will become apparent, changes may be made in the function and/or arrangement of any of the elements described in the disclosed exemplary embodiments without departing from the spirit and scope of the claims.

Embodiments provide for a drum with an adjustable depth. As described above, drums of the prior art consist of a top head mounted on a shell of a fixed depth. Typically, a bottom head would be mounted on the other end of the shell. While tension of the drum head can be changed by adjusting the tension rods, requiring the adjustment of from 4 to 20 lugs, the amount of change in the sound of the drum is fairly small.

Embodiments of the present drum contain a shell with an adjustable depth. One particular embodiment comprises a snare drum with a 14 inch diameter and a depth adjustable from approximately 4 inches to approximately 7 inches. While much of the discussion that follows discusses a snare drum embodiment, it should be understood that tom-toms, floor toms, bass drums, and other types of drums that currently exist or may be invented in the future can also include this feature. It should also be noted that different diameters and depths can be used in various embodiments.

Figure 1:
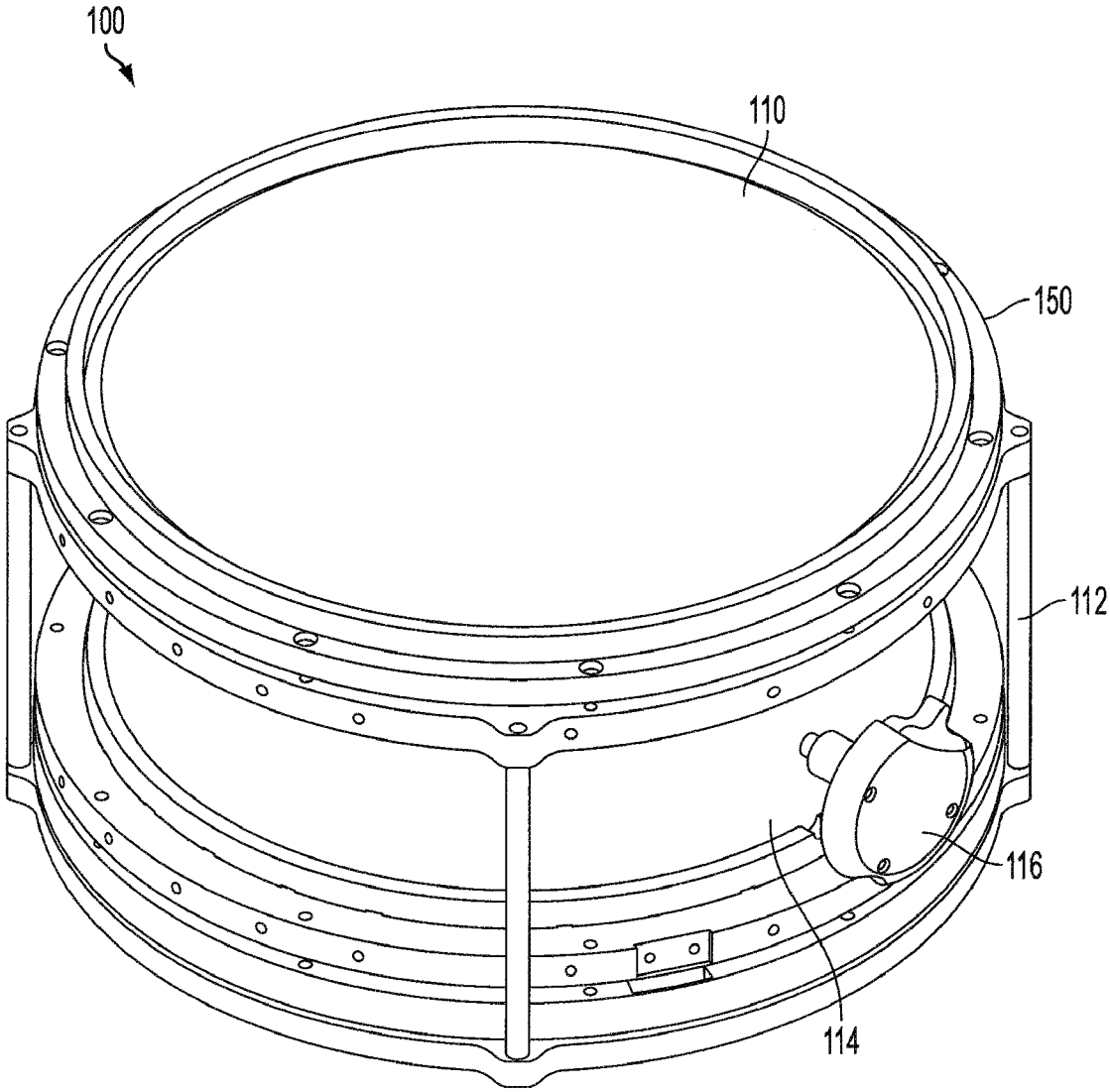
FIG. 1 is an isometric diagram illustrating one particular embodiment of a drum of the present invention.

With reference to FIG. 1, an isometric view of an embodiment of drum 100 is presented. Drum 100 comprises a head 110, a frame 112, a shell 114. Also shown is a handle 116. Head 110 is attached to shell 114 via rim 150. There is also a head on the bottom of the drum (not shown). In a typical drum, head 110 is at a fixed distance from the bottom head.

Figure 2A:
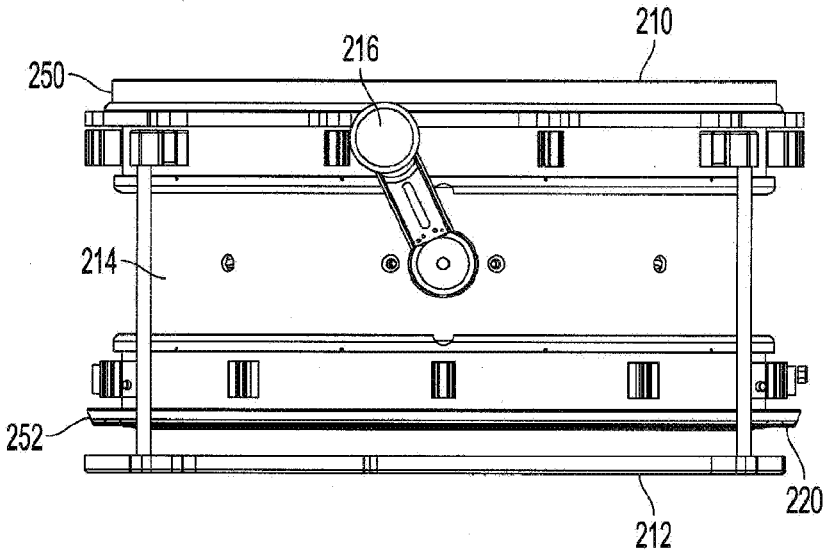
FIGS. 2A and 2B show a side view illustrating an embodiment of a drum in both an extended position and in a compressed position.
Figure 2B:
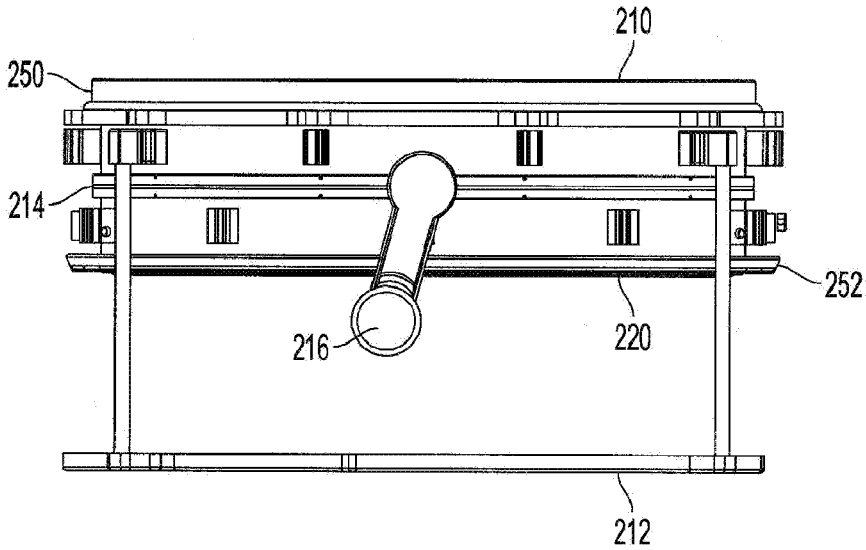

FIGS. 2A and 2B show a side view of drum 200 in two different configurations. In FIG. 2A, drum 200 is in the extended position (i.e., the distance between the top head and the bottom head is at a maximum). Drum 200 contains top head 210, frame 212, shell 214, handle 216, and bottom head 220. Bottom head 220 is approximately 7 inches from top head 210. Top head 210 is coupled to shell 214 via rim 250. Rim 250 contains tension rods that are used to adjust the tension on the head. In a similar manner bottom head 220 is coupled to shell 214 via rim 252. It should be understood that not all drums will have a bottom head, as some drums have a single head configuration. In such a configuration, rim 252 would not be necessary. For such a configuration, although portions of the disclosure refer to the distance between a top head and a bottom head, it should be understood to refer to the distance between a top head and the bottom of the shell 214. In FIG. 2B, drum 200 is shown in the compressed position (i.e., the distance between the top head and the bottom head is at a minimum). Top head 210, frame 212, shell 214, handle 216, rim 250, and rim 252 are the same as in FIG. 2A. However, bottom head 220 is only approximately 4 inches from top head 210. It should be noted that the bottom of frame 212 is at the same position in FIG. 2A and FIG. 2B. Thus, when drum 200 is placed in a stand, head 210 remains in the same position.

By changing the distance between top head 210 and bottom head 220, the sound of drum 200 is changed. For example, when bottom head 220 is in the compressed position shown in FIG. 2B, the drum is higher pitched than when bottom head is in the extended position shown in FIG. 2A. In addition, the snare response will be faster in the compressed position. It should be understood that, while only two positions are shown in FIGS. 2A and 2B, there may be many intermediate positions between the compressed and extended positions that are available to a user. Using these intermediate positions along with the extended and compressed position can allow a user much flexibility in setting up the drum. In addition to the pitch of the drum being changed, the resonance of the drum is changed when the depth is adjusted. Thus, a drummer may find the drum sounds different in a large concert hall compared to when the drum is in a smaller club. The drummer can adjust the depth of the drum in order to fine tune the resonance of the drum to better match the acoustic qualities of the room.

Handle 216 is used to change the depth of the drum. Turning handle 216 in a counter-clockwise direction results in the depth of the drum getting smaller. Turning handle 216 in the clockwise direction results in the depth of the drum getting larger. Handle 216 may be in any of a variety of different form factors. For example, handle 216 may be circular or it may have a handle such that a user has additional leverage in adjusting the depth of the drum. Handle 216 may include a ratchet mechanism such that the location of handle 216 remains fixed until manually moved. Such a mechanism may also be accomplished using a clutch, a latch, hydraulics, or any similar type of mechanism. Other configurations are possible besides a hand-operated mechanism. For example, a foot pedal could be used to adjust the depth of the drum. An electric motor can be used to control the depth. The use of an electric motor to adjust the depth of the drum has the added benefit of allowing simultaneous adjustment of multiple drums, should a kit contain multiple drums that contain an embodiment of the present invention.

Figure 3:
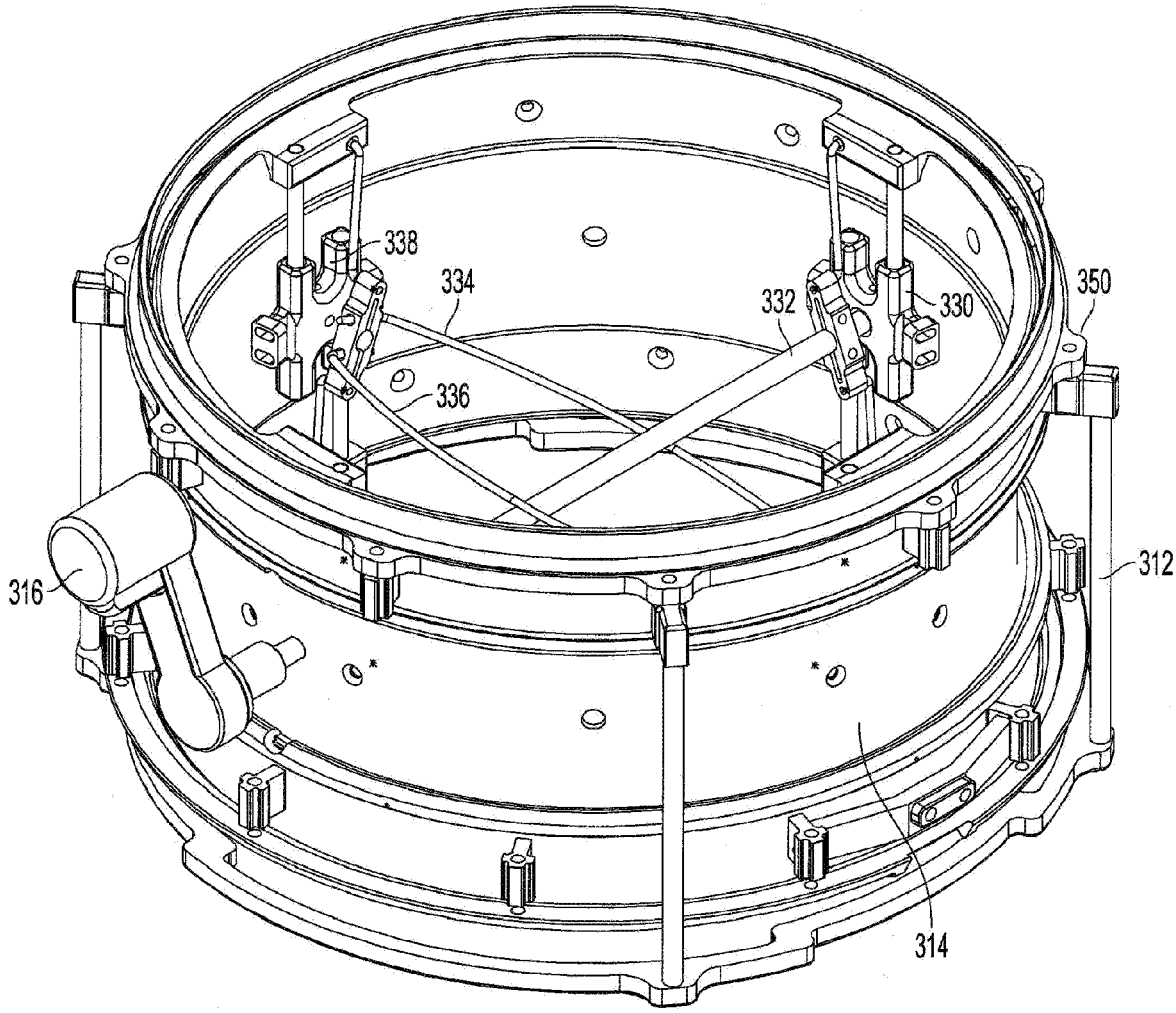
FIG. 3 is an isometric view of an embodiment showing the inside of a drum.

An embodiment of the invention can be constructed in a variety of different ways such that the bottom head moves from the top head. One particular embodiment is illustrated in FIG. 3. FIG. 3 shows an isometric, cutaway view of an embodiment of the invention in the extended position. To illustrate the inner workings of this embodiment, the top head and bottom head are not shown. Frame 312, shell 314, handle 316, and rim 350 are similar to items 212, 214, 216, 250 shown in FIGS. 2A and 2B. Handle 316 is coupled to drive shaft 332 to engage drive sleeve 330 on the opposite side of shell 314 from handle 316. As handle 316 is rotated, drive sleeve 330 translates the rotational motion into linear motion. A drive sleeve similar to drive sleeve 330 is present just inside shell 314, opposite drive sleeve 330 is present to also translate the rotational motion into linear motion. Drive shaft 332 allows drive sleeve 330 and the counterpart drive sleeve to move in sync with each other. A similar drive sleeve 338 is also present 90 degrees away from drive shaft 332. Drive sleeve 338 is coupled via drive shaft 334 and drive shaft 336 to a similar drive sleeve on the opposite side of drive shafts 334 and 336. As the heads move away from each other, the linear movement is translated to rotational motion. While drive shafts 334 and 336 are shown as two separate pieces, they are joined together at drive sleeve 338 and at a corresponding drive sleeve at the other end of drive shafts 334 and 336. It should be understood that drive shafts 334 and 336 could be replaced by a single drive shaft, a three-piece drive shaft, or any other type of mechanism that can be used to join and synchronize drive sleeves.

The purpose of the drive sleeves and drive shafts is to ensure that the drum heads remain substantially parallel as they move. As handle 316 is rotated, a drive sleeve translates the movement into linear movement. At the same time, drive shaft 332 turns drive sleeve 330. Thus, both the side next to the handle and the opposite side move at the same rate. As the heads move apart from each other, drive sleeve 338 rotates, causing drive shafts 334 and 336 to rotate, moving the drive sleeve on the opposite side of the drive shafts. In this manner, the drive sleeves are synchronized to move simultaneously to move the drum heads such that they remain substantially parallel throughout the range of motion. Although it is possible to have drums heads that are not parallel, it may be acoustically desirable to have the heads close to parallel.

Figure 4A:
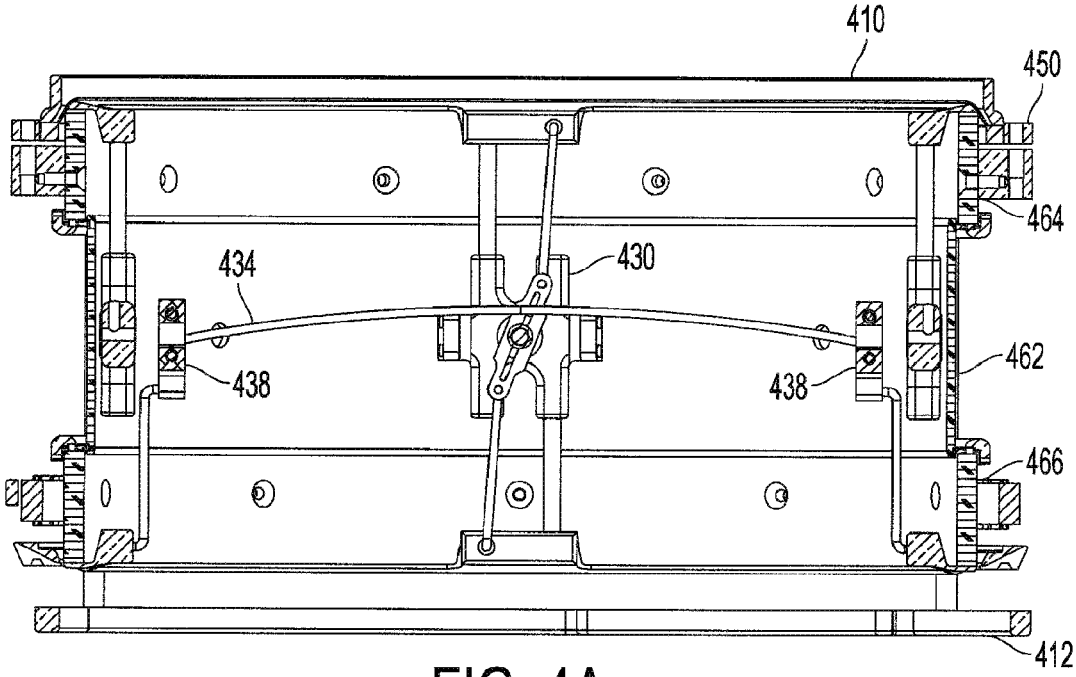
FIG. 4A and 4B show a side cutaway view of an embodiment.
Figure 4B:
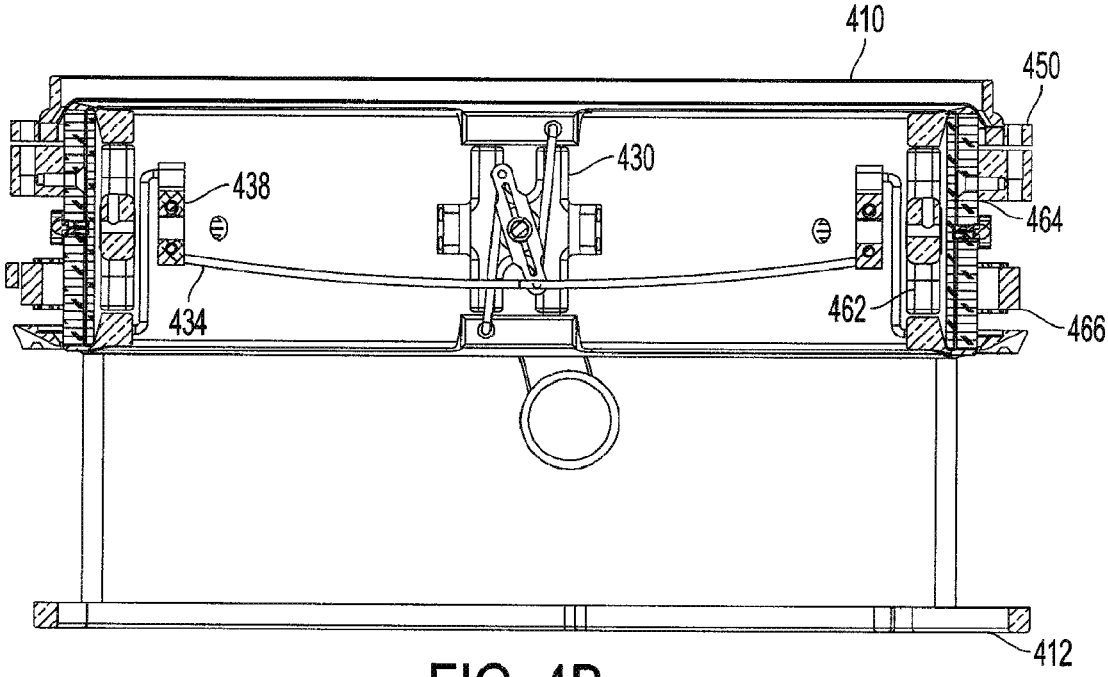

FIGS. 4A and 4B show a side cutaway view of an embodiment. FIG. 4A shows a drum in the extended position. FIG. 4B shows a drum in the compressed position. Head 410, frame 412, drive sleeve 430, drive shaft 434, drive sleeves 438, and rim 450, are similar to the similarly numbered items in FIG. 3. It should be noted that although FIG. 3 shows two drive shafts 334 and 336, FIGS. 4A and 4B show an embodiment with a single drive shaft 434. It should be understood that either embodiment could be used. The construction of the shell is shown in more detail in FIGS. 4A and 4B, though. There is an inner shell 462 and two outer shell portions 464 and 466. The inner shell is where the drive sleeves and handle are coupled. As the drum moves from the extended position to the compressed position, outer shell 464 and outer shell 466 overlap with inner shell 454.

The shell of the drum can be of any type of material traditionally used for drum shells. This includes various types of woods and metals, including birch, maple, brass, and aluminum. The frame can be made of any type of material. Typically, it would be a metal, for strength and weight purposes.

The implementations listed here, and many others, will become readily apparent from this disclosure. From this, those of ordinary skill in the art will readily understand the versatility with which this disclosure may be applied. Implementations of a drum may be constructed of a wide variety of materials, including as described above. Those of ordinary skill in the art will readily be able to select appropriate materials and manufacture these products from the disclosures provided herein.

It will be understood that implementations are not limited to the specific components disclosed herein, as virtually any components consistent with the intended operation of a method and/or system implementation for a drum may be utilized. Accordingly, for example, although particular component examples may be disclosed, such components may comprise any shape, size, style, type, model, version, class, grade, measurement, concentration, material, weight, quantity, and/or the like consistent with the intended operation of a method and/or system implementation for a drum may be used.

In places where the description above refers to particular implementations of a drum, it should be readily apparent that a number of modifications may be made without departing from the spirit thereof and that these implementations may be applied to other drums. The presently disclosed implementations are, therefore, to be considered in all respects as illustrative and not restrictive.

We claim:

1. A drum comprising:

a shell;

a top head coupled to the shell;

a bottom head coupled to the shell; and a frame wherein the distance between the top head and the bottom head is adjustable between a minimum and a maximum distance; and wherein said frame is fixed in relation to the top head and wherein said bottom head moves vertically within said frame.

2. The drum of claim 1 further comprising: a mechanism to adjust said distance between the top head and the bottom head.

3. The drum of claim 1 wherein said frame comprises a circular cylindrical shape.

4. The drum of claim 1 wherein said shell comprises an inner shell and a first outer shell.

5. The drum of claim 4 further comprising a second outer shell.

6. The drum of claim 4 wherein said first outer shell is configured to partially cover said inner shell.

7. The drum of claim 1 wherein said top head remains substantially parallel to said bottom head throughout the range of motion.

8. The drum of claim 1 wherein said drum is a snare drum.

9. The drum of claim 1 wherein said drum is a tom-tom.

10. The drum of claim 1 wherein said drum is a bass drum.

11. The drum of claim 1 wherein said bottom head is removable.

12. The drum of claim 1 wherein said mechanism comprises:

a first drive sleeve;

a drive shaft coupled to said first drive sleeve;

a second drive sleeve coupled to said drive shaft;

wherein, said first drive sleeve and said second drive sleeve are coupled to the shell of a drum.

13. The drum of claim 12 further comprises a device to operate said first drive sleeve, and wherein said first and second drive sleeves are configured to translate movement of the mechanism into movement of the second drum head.

14. The drum of claim 13 wherein said device comprises a rotatable handle.

15. The drum of claim 14 wherein said rotatable handle is ratcheted to maintain a setting.

16. The drum of claim 13 wherein said device comprises a foot-operated pedal.

17. A mechanism for adjusting the depth of a drum comprising:

a first drive sleeve;

a drive shaft coupled to said first drive sleeve;

a second drive sleeve coupled to said drive shaft;

wherein, said first drive sleeve and said second drive sleeve are coupled to the shell of a drum.

18. The mechanism of claim 7 further comprising: a device used to rotate said first drive sleeve; wherein, said first drive sleeve is configured to translate said rotation into a vertical motion to extend or retract a drum head.

19. A drum comprising:

a shell;

a top head coupled to the shell;

a bottom head coupled to the shell;

a first drive sleeve;

a drive shaft coupled to said first drive sleeve;

a second drive sleeve coupled to said drive shaft;

wherein the distance between the top head and the bottom head is adjustable between a minimum and a maximum distance; and wherein, said first drive sleeve and said second drive sleeve are coupled to the shell of a drum.

20. The drum of claim 19 further comprises a device to operate said first drive sleeve, and wherein said first and second drive sleeves are configured to translate movement of the mechanism into movement of the second drum head.

* * * * *